United States Patent [19]

Prengaman

[11] 4,439,398

[45] Mar. 27, 1984

[54] METHOD OF ALLOYING CALCIUM AND ALUMINUM INTO LEAD

[75] Inventor: Raymond D. Prengaman, Arlington, Tex.

[73] Assignee: RSR Corporation, Dallas, Tex.

[21] Appl. No.: 321,051

[22] Filed: Nov. 13, 1981

[51] Int. Cl.[3] ..... C22C 11/00

[52] U.S. Cl. ..... 420/564; 420/563; 420/590

[58] Field of Search ..... 420/415, 563, 564, 590

[56] References Cited

U.S. PATENT DOCUMENTS

| | | | |
|---|---|---|---|
| 1,703,212 | 2/1929 | Shoemaker | 75/167 |
| 1,745,721 | 2/1930 | Shoemaker | 75/167 |
| 1,745,729 | 2/1930 | Shoemaker | 75/167 |
| 1,791,148 | 2/1931 | Shoemaker | 75/167 |
| 1,804,883 | 5/1931 | Mathesius et al. | 75/167 |
| 1,808,793 | 6/1931 | Shoemaker | 75/167 |
| 1,813,324 | 7/1931 | Shoemaker | 75/167 |
| 1,815,528 | 7/1931 | Shoemaker | 75/167 |
| 1,916,496 | 7/1933 | Shoemaker | 75/167 |
| 2,031,486 | 2/1936 | Kirsebom | 420/564 |
| 2,210,504 | 8/1940 | Shoemaker | 75/167 |
| 2,290,296 | 7/1942 | Siegens et al. | 75/167 |
| 3,741,754 | 6/1973 | Mainland | 420/564 |
| 3,920,473 | 11/1975 | Sims | 136/65 |
| 3,939,009 | 2/1976 | Barnes et al. | 136/66 |
| 4,125,690 | 11/1978 | Bagshaw | 429/226 |
| 4,233,070 | 11/1980 | McWhinnie et al. | 75/167 |

FOREIGN PATENT DOCUMENTS

| | | | |
|---|---|---|---|
| 433653 | 8/1935 | United Kingdom | 75/167 |

*Primary Examiner*—Brian E. Hearn
*Assistant Examiner*—David A. Hey

[57] ABSTRACT

Calcium and aluminum are alloyed into lead by adding a eutectic calcium-aluminum alloy to molten lead preferably at a temperature of at least 1020°. The eutectic alloy contains about 73% calcium and about 27% aluminum.

3 Claims, No Drawings

METHOD OF ALLOYING CALCIUM AND ALUMINUM INTO LEAD

BACKGROUND OF THE INVENTION (a) Field of the Invention

This invention relates to a method of making a lead-calcium-aluminum alloy at relatively low temperatures and without resorting to use of inert gases or fluxes.

(b) State of the Art

Aluminum is often added to lead-calcium and lead-calcium-tin alloys to prevent oxidation of the calcium during remelting of the alloy and subsequent casting and handling of the molten metal. Such use of aluminum in lead-calcium-tin alloys is described in U.S. Pat. No. 4,125,690.

A common method of alloying aluminum into lead entails melting and heating the lead to a temperature above the melting point of aluminum (660° C.). At this temperature the aluminum melts and becomes alloyed with the lead readily with some loss due to oxidation. At temperatures below the melting point of aluminum an external adherent oxide skin prevents the aluminum from dissolving in the lead even though it is soluble in small amounts. Therefore aluminum and lead cannot be effectively alloyed at temperatures below 660° C.

Calcium is generally alloyed into lead under an inert gas or molten salt cover to prevent oxidation. High temperatures are required to keep the salt cover molten or to effect complete dissolution of $Pb_3Ca$ compounds into the lead. By means of this procedure a master alloy of 1–2% calcium is normally produced. The master alloy is then added to lead or lead-aluminum alloy to produce the final alloyed product.

Several problems are associated with the current approach to alloying calcium and aluminum into lead. First, the kettles used in alloying the lead must be heated to temperatures above 660° C. to permit efficient addition of aluminum. This dramatically reduces the life of the alloying kettle. In addition recovery of calcium in making the 1–2% master alloy is generally less than 90% because of oxidation of the calcium during alloying and pouring despite the inert gas and salt covers. Finally, because of the limited solubility of aluminum in lead, it is not possible to directly alloy the aluminum into the calcium-lead master alloy.

A new direct method of alloying calcium and aluminum with lead alloys has now been discovered. The method avoids the use of inert atmospheres or flux covers; gives nearly 100% recovery of calcium and aluminum and is operative at low temperatures where damages to alloying kettles is negligible. Moreover, because of the lower temperature requirements, fuel requirements are reduced.

SUMMARY OF THE INVENTION

This invention provides a method of alloying calcium and aluminum in lead comprising melting and heating lead to at least 1020° F. and stirring a eutectic calcium and aluminum alloy, generally containing about 73 weight % calcium and about 27 weight % aluminum, into the heated lead.

DETAILED DESCRIPTION OF THE INVENTION

This invention relates to a direct method of producing a lead-calcium-aluminum alloy without use of a lead-calcium master alloy and at relatively low temperatures. By means of the method losses of alloying elements are minimized.

The method of the invention comprises adding a eutectic calcium-aluminum alloy containing about 73% calcium and about 27% aluminum to molten lead to a temperature preferably of at least about 1020° F. Since the eutectic melts at 1020° F. (545° C.) it is unnecessary to resort to temperatures above the melting point of aluminum, i.e. above 660° C. The calcium-aluminum eutectic can be alloyed below 1020° F., e.g., as low as 900° F.; however, substantial losses of aluminum result. The aluminum in the eutectic alloy protects the calcium from oxidation during alloying. The process of the invention thus permits high levels of recovery of calcium and aluminum.

The eutectic alloy employed in the present method is known in the art and its manufacture is not a part of the present invention. Typically the eutectic alloy may be formed by simply melting aluminum and thereupon adding the calcium.

The eutectic alloy need not contain precisely 73% calcium and 27% aluminum. Use of alloys which deviate a few percentage points for either or both materials is within the scope of the present invention provided the deviations do not necessitate significantly elevating the temperature at which the present method is effective. Similarly other materials which do not require substantially elevating the temperature of operation may be present in the eutectic alloy.

The following example is illustrative of the invention.

EXAMPLE

Four hundred two (402) pounds of pure lead was melted in a cast iron melt pot and heated to 1100° F. 463 Grams of calcium-aluminum master alloy (manufactured by Pfizer, Inc., Materials, Pigments and Metals Division, Wallingford, Conn.) averaging 72.4% calcium and 25.3% aluminum was added with stirring to the heated lead.

The resulting lead alloy was poured into ingots and sampled. The chemical analyses and losses of alloying elements were as follows:

| Sample Wt. (%) | Expected Wt. (%) | Loss Wt. | Percent Loss |
|---|---|---|---|
| Ca 0.179 | 0.182 | .003 | 1.6% |
| Al 0.054 | 0.064 | .010 | 15.6% |

The aluminum in the Ca-Al master alloy protected the calcium and almost eliminated loss thereof.

I claim:

1. A method of making a lead-calcium-aluminum alloy at low temperature, without an inert flux and with minimal losses of aluminum and calcium comprising:
   (a) melting lead;
   (b) heating the molten lead; and
   (c) stirring a eutectic calcium-aluminum alloy into the heated molten lead.

2. Method of claim 1 wherein the calcium-aluminum alloy has an average content of 73% calcium and 27% aluminum.

3. Method of claim 1 wherein the lead is heated to at least 1020° F.

* * * * *